US012215518B2

(12) United States Patent
Niewiarowski

(10) Patent No.: US 12,215,518 B2
(45) Date of Patent: Feb. 4, 2025

(54) SWIMMING POOL CLEANER WATER SURFACE DIVERTER

(71) Applicant: Kreepy Krauly Australia Pty Ltd, Western Australia (AU)

(72) Inventor: Wieslaw Niewiarowski, Western Australia (AU)

(73) Assignee: Kreepy Krauly Australia Pty Ltd, Western Australia (AU)

( * ) Notice: Subject to any disclaimer, the term of this patent is extended or adjusted under 35 U.S.C. 154(b) by 106 days.

(21) Appl. No.: 17/754,881

(22) PCT Filed: Oct. 19, 2020

(86) PCT No.: PCT/AU2020/051125
§ 371 (c)(1),
(2) Date: Apr. 14, 2022

(87) PCT Pub. No.: WO2021/072509
PCT Pub. Date: Apr. 22, 2021

(65) Prior Publication Data

US 2024/0093523 A1 Mar. 21, 2024

(30) Foreign Application Priority Data

Oct. 18, 2019 (AU) ..... 2019903939

(51) Int. Cl.
*E04H 4/16* (2006.01)

(52) U.S. Cl.
CPC ..... *E04H 4/1672* (2013.01)

(58) Field of Classification Search
None
See application file for complete search history.

(56) References Cited

U.S. PATENT DOCUMENTS 6,119,293 A * 9/2000 Phillipson ..... E04H 4/1663 15/246
6,473,928 B1 * 11/2002 Veloskey ..... E04H 4/1663 210/167.16

(Continued)

FOREIGN PATENT DOCUMENTS

AU 2010100333 A4 5/2010
EP 188883 A2 7/1986

(Continued)

OTHER PUBLICATIONS

International Search Report issued for International Patent Application No. PCT/AU2020/051125, dated Jan. 11, 2021 in 3 pages.

*Primary Examiner* — S. Joseph Morano
*Assistant Examiner* — Jovon E Hayes
(74) *Attorney, Agent, or Firm* — Knobbe, Martens, Olson & Bear, LLP

(57) ABSTRACT

A pool cleaner water surface diverter 7 that will break the pool water surface 1 before the pool cleaner 4 reaches the surface, or at least before the suction of the cleaner 4 is able to suck in air. A rim 12 extends beyond a physical envelope of the cleaner, such as being wider than is the cleaner. Ideally the diverter has neutral or near neutral buoyancy in the pool water. A central hub on a pool hose 5 allows rotation of the diverter relative to the hose. compartments/containers may contain a substantially buoyancy neutral fluid or material in water e.g. PVA foam.

20 Claims, 6 Drawing Sheets

(56) References Cited

U.S. PATENT DOCUMENTS

| | | | | |
|---|---|---|---|---|
| 6,625,833 | B1 * | 9/2003 | Campbell | E04H 4/1663 15/246 |
| 9,121,191 | B2 * | 9/2015 | Kellogg | E04H 4/1663 |
| 2015/0259940 | A1 * | 9/2015 | Renaud | E04H 4/1672 15/1.7 |

FOREIGN PATENT DOCUMENTS

| | | | | |
|---|---|---|---|---|
| EP | 0475736 | A1 * | 9/1991 | E04H 4/1654 |
| WO | 02/075083 | | 9/2002 | |

* cited by examiner

SWIMMING POOL CLEANER WATER SURFACE DIVERTER

CROSS-REFERENCE TO RELATED APPLICATIONS

This application is the U.S. National Phase under 35. U.S.C. § 371 of International Application PCT/AU2020/051125, Oct. 19, 2020, which claims priority to Australian Patent Application No. 2019903939, filed Oct. 18, 2019. The disclosures of the above-described applications are hereby incorporated by reference in their entirety.

FIELD OF THE INVENTION

The present invention relates to swimming pool cleaners and in particular to mechanical suction pool cleaners.

BACKGROUND TO THE INVENTION

Automatic pool cleaners endeavour to maintain a pool with minimal, if any, human interaction. Their role is similar to that of a vacuum cleaner, and designed to collect sand, leaves, debris and insects, from a swimming pool. However, rather than be pushed along the pool floor by a person, the automatic pool cleaner is designed to move around the pool autonomously. That is, the automatic pool cleaner is a self-propelled device, which during operation attaches to the surface (floor and walls) of the swimming pool by negative pressure (vacuum).

In general, pool cleaners can be divided into two groups:

1. Electric cleaners driven by an electric motor connected by a flexible cable from an external power supply or from the internal batteries.
2. Suction cleaners being mechanical devices, driven by a water turbine connected to the pool's external filtration system by a flexible hose.

While some cleaners are designed to only clean the bottom 2 of the pool, most are designed to also climb and clean the walls 3, including right up to the pool water surface 1. The major problem with cleaners that can climb is the detection of the pool water surface 1. If the cleaner 4 climbs up too high, it can climb out of the water and start sucking air, which can cause significant damage to the filtration system.

This is particularly, although not exclusively, a problem for mechanical suction cleaners, as they do not have electronic sensors. As such, they have to, or at least should, rely on other methods to prevent the cleaner from climbing out of the water to the point where air can be sucked into the cleaner.

A proven method to address this problem, as shown in FIG. 1, is to attach the pool cleaner hose 5 at the front of the cleaner 4, at an angle between 45° to 80° degrees to the pool surface 1. In this arrangement, as can be seen in FIG. 1, as the cleaner 4 is climbing to the top of the pool, the hose 5 breaks the surface 1 of the water first and the weight of the hose 5 filled with water will then force the cleaner 4 downward preventing it from climbing up.

A limitation of this solution is that it only works on cleaners travelling in one direction. It is understood that if the cleaner was to move in a different direction that the hose would not break the surface first. For example, if the cleaner of FIG. 1 was travelling in the reverse direction, the actual cleaner would break the water surface well before the hose.

An alternative solution, and generally adopted by reversing cleaners, as shown in FIG. 2, is to use a ballast 6 (e.g. of a ballast volume 6*a*) located at the front of the cleaner 4. As the ballast 6 emerges from the water the cleaner 4 is prevented from climbing up too high. This arrangement can be seen in FIGS. 2 and 3.

The protruding ballast needs to be very large to be effective as the traction force can vary significantly due to various reasons such as the pool surface finish, condition of the filtration system, and water chemistry. However, the ballast should not be too large otherwise the ballast itself could become an obstacle, preventing the cleaner from climbing, and in some cases also damaging the bottom of the pool wall.

A further problem with the use of a ballast is that it is ineffectual if the cleaner travels on the wall and breaks the surface of the water at a shallow angle as shown in FIGS. 4 and 5. In this case, air ('A') could then be sucked into the cleaner resulting in damage to the system or poor pool cleaner, filter or pump performance due to air in the system.

There therefore remains a need, for a system and method that reduces the risk of a pool cleaner breaking the water surface of the pool, and sucking air into the cleaner.

SUMMARY OF THE INVENTION

In a broad form of the present invention, there is provided an apparatus that diverts a mechanical pool cleaner away from the pool water surface.

In a first aspect of the present invention, there is provided a swimming pool cleaner water surface diverter, wherein the diverter connects to or is part of a swimming pool cleaner, and wherein a portion of the diverter is arranged and configured, in use, to breach a surface of the water and restrict or prevent the pool cleaner from breaching the water surface sufficient for the pool cleaner to intake air.

A portion of the diverter can project beyond a physical envelope defined by a body of the pool cleaner.

The diverter may include at least one support member extending from a central hub to a rim, said rim extending beyond the envelope of the pool cleaner. The central hub can provide an axle housing. The rim may be annular, oval or substantially circular.

The rim can have neutral buoyancy or near neutral buoyancy (e.g. up to +/−10%, preferably +/−5%, preferably +/−2%, of neutral buoyancy).

The rim may include a plurality of compartments or containers. The compartments/containers may be partially or fully filled with a substantially buoyancy neutral fluid or material in water. The material may be or include PVA foam. One or more of the compartments/containers may be at least partially hollow and configured to receive pool water.

The diverter may have substantially neutral buoyancy or approaching neutral buoyancy in the swimming pool when the one or more compartments/containers contain the pool water.

Preferably, some positive or negative buoyancy is compensated for without affecting the function of the pool cleaner.

One or more of the compartments/containers may comprise multiple caps that connect together.

One or more said compartments/containers connects onto a rib of the diverter or fit into a cage on an end of said rib or the rib includes a claw like structure adapted to hold the respective compartment/container.

The respective compartment/the container may be at least partially filled with PVA sponge or other sponge or open cell material.

A cross section through a thickness of a peripheral diameter of the rim may be around at least 15% of an overall diameter of the rim diameter.

The diverter or the support member may be moulded as a single part.

Preferably the diverter is configured to attach to, or form part of, a pool hose or to the pool cleaner.

The diverter preferably includes a connector to attach the diverter to a pool hose, the connector including an adjuster means to allow positioning of the diverter on the pool hose.

The adjuster means preferably includes a number of flexible claws, teeth or tines to allow positioning and locking the diverter in place on the pool hose.

An annular, tube, circular or ring like device may be provided connectable to the pool hose, and a hub to which the support member(s) is/are connected, with the hub able to rotate around the pool hose.

An outside diameter (ø) of the diverter may be larger than a length (l) of the pool cleaner.

Relative width of the diverter may be at least 130% the width of the pool cleaner; or, when the diverter is proximate the pool cleaner in use, the size ratio of the diverter is approximately 165% that of the length of the pool cleaner; or when the diverter is located along the pool hose away from the pool cleaner, the size of the diverter is up to 200% of the length (l) of the pool cleaner.

A position of the diverter on the pool hose may be about equal to the size of the diverter (l) distance from a floor of the swimming pool when the pool cleaner is on the floor; or a minimum distance from the diverter to the pool floor may be around the length of the pool cleaner; or a maximum height of the diverter from the pool floor may be approximately the outside diameter of the diverter.

The rim may be substantially circular, and preferably is substantially buoyancy neutral. The rim may also be comprised of a plurality of compartments.

In another aspect the present invention provides a swimming pool cleaner water surface diverter comprising: a connector for joining the diverter to the cleaner; at least one rib extending from the connector to a body, the body extending beyond the perimeter of the cleaner.

Features of any aspect or embodiment of the present invention may be combined with any one or more other such aspects or embodiments.

BRIEF DESCRIPTION OF THE DRAWINGS

An illustrative embodiment of the present invention will now be described with reference to the accompanying figures. Further features and advantages of the invention will also become apparent from the accompanying description.

DESCRIPTION OF PREFERRED EMBODIMENTS

The following description is presented to enable any person skilled in the art to make and use the invention and is provided in the context of a particular application and its requirements.

Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

Figure 1:
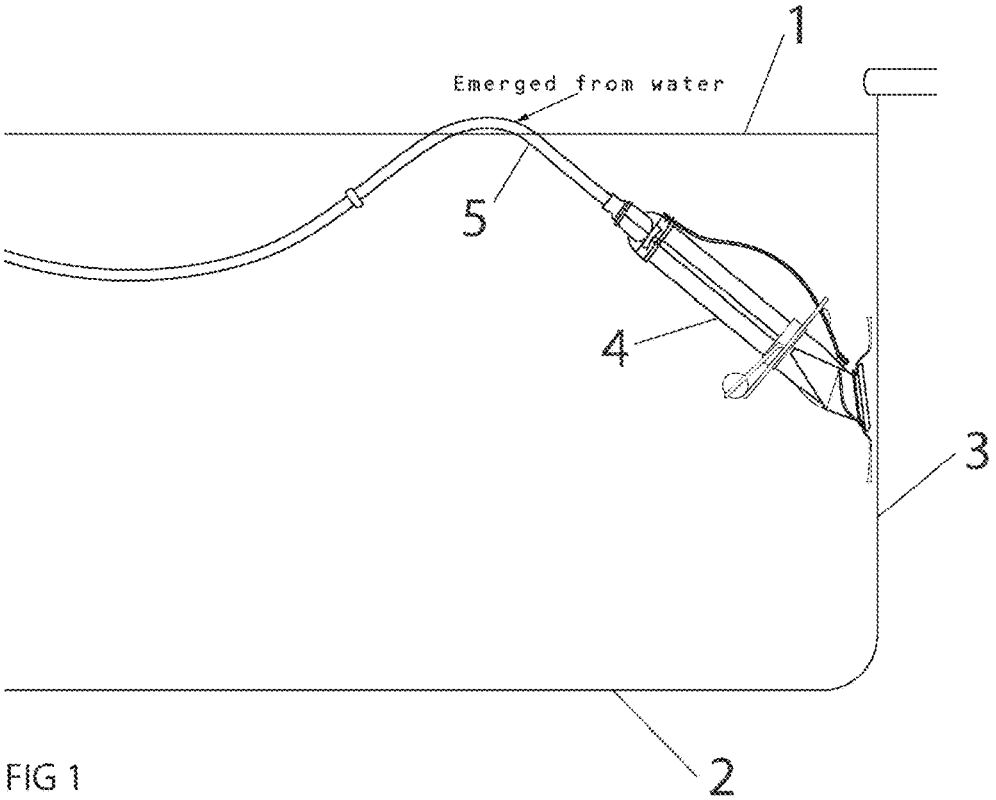
FIG. 1 shows a pool cleaner with a fixed hose.
Figure 2:
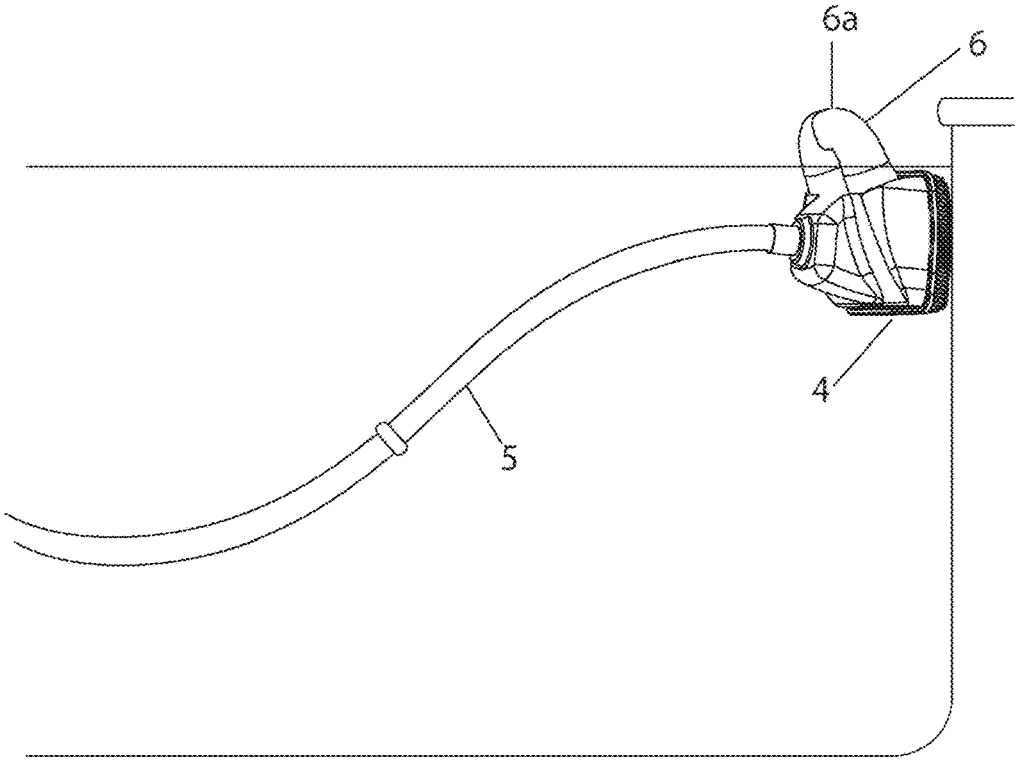
FIG. 2 shows a pool cleaner with a front ballast.
Figure 3:
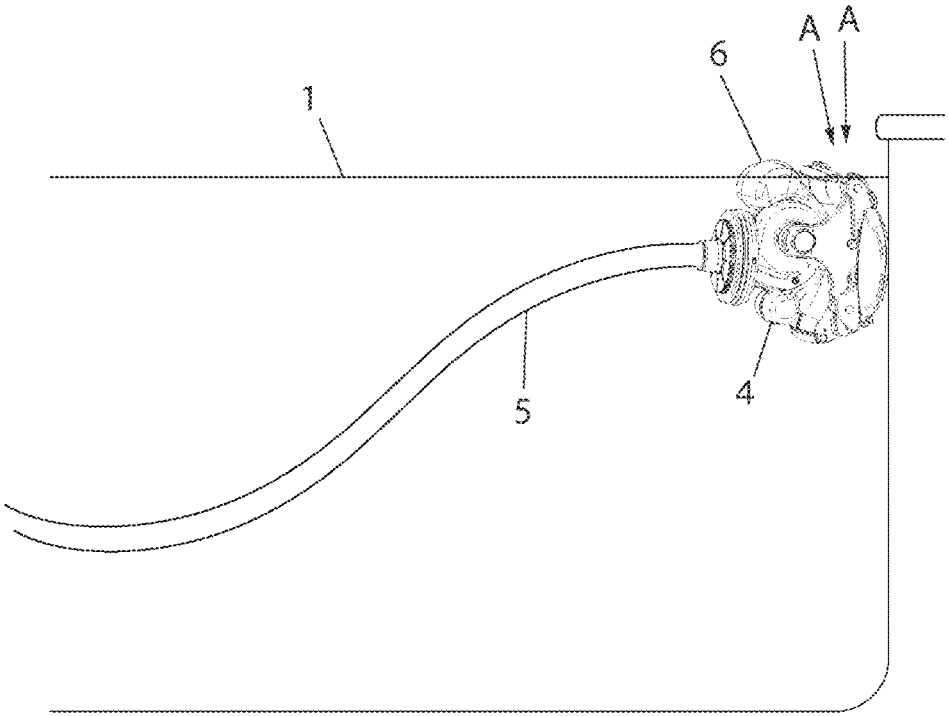
FIG. 3 shows another pool cleaner with a front ballast.
Figure 4:
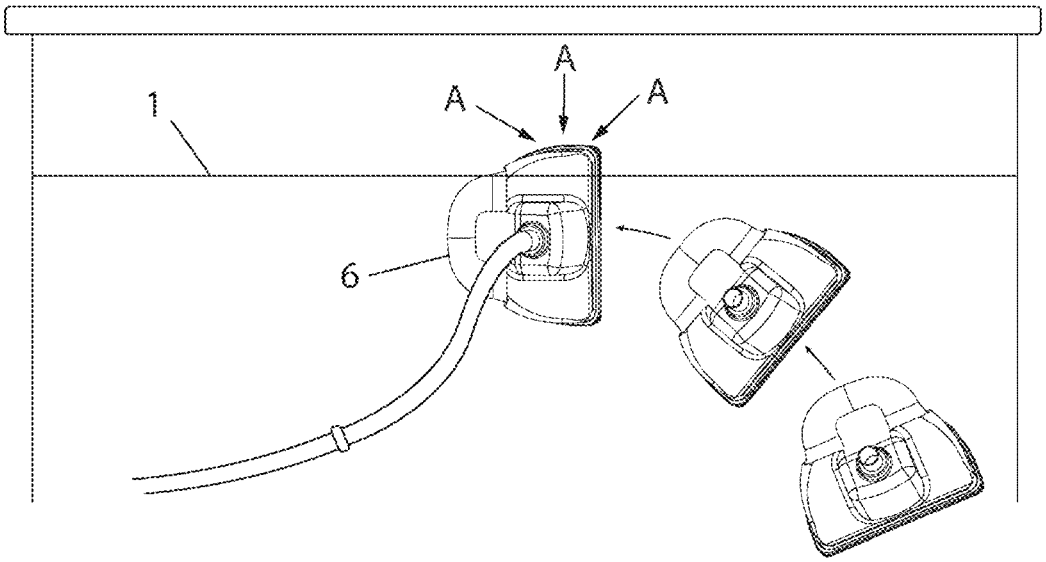
FIG. 4 illustrates a pool cleaner breaking the water surface at a shallow angle.
Figure 5:
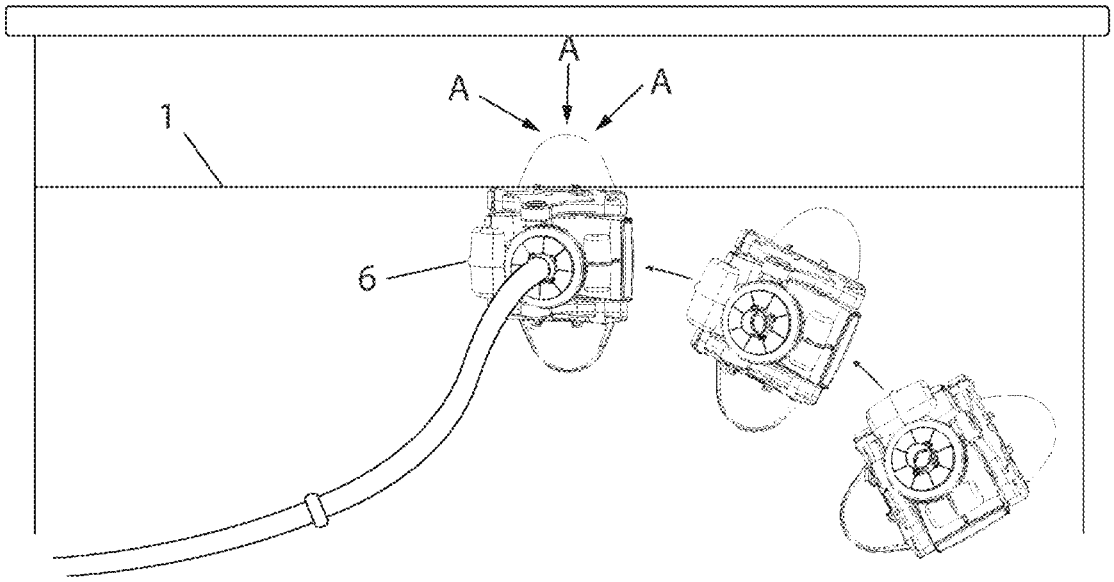
FIG. 5 illustrates another pool cleaner breaking the water surface at a shallow angle.

As shown in FIGS. 3, 4 and 5, air 'A' can be sucked into the pool cleaner when the pool cleaner partially breaches the water surface. This causes loss of performance, potential cavitation in the pool pump and air through the filter system.

Figure 6:
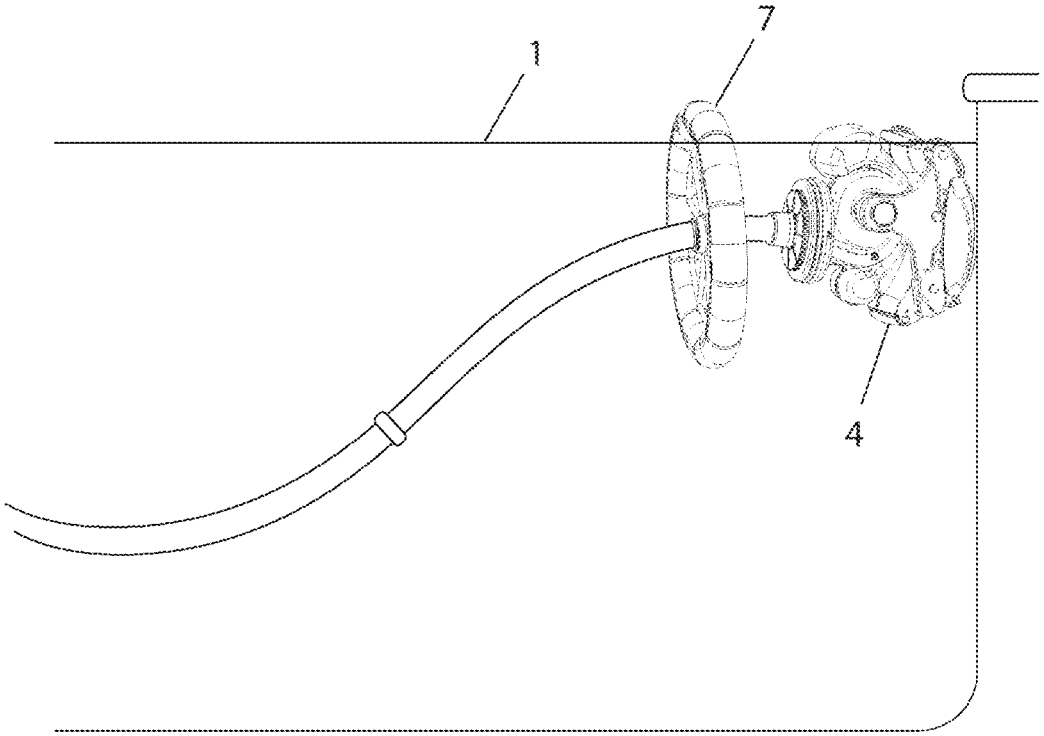
FIG. 6 illustrates one embodiment of the present invention attached to a pool cleaner.

In a preferred embodiment, a water surface diverter 7 in a shape of a wheel is provided as exemplified in FIG. 6. The diverter 7 is designed so that no matter the direction of travel of the cleaner 4, the diverter will break the pool water surface 1 before the cleaner 4 reaches the surface, or at least before the suction of the cleaner 4 is able to suck in air.

The wheel shaped diverter 7 is also effective if the cleaner 4 travels along the pool wall and breaks the water surface at a shallow angle (as shown in FIGS. 4 and 5). In this situation the diverter 7 will still break the surface of the water 1 before the cleaner 4 is able to suck in air.

The shape of the diverter 7 will be generally circular, such as like a bicycle wheel, or at least substantially circular. However, in some embodiments the diverter may be more oval in shape. This may be preferred for some cleaners that have a more pronounced rectangular footprint. By employing an oval shaped diverter the overall size can be limited. In further alternatives, the overall shape could be square or rectangular. In another alternative, the diverter will take a shape similar to a cross potent.

Ideally the diverter 7 will have a neutral buoyancy in the pool water. When an object floats it is said to have positive buoyancy. When an object sinks it is said to have negative buoyancy. If the object neither floats nor sinks it has neutral buoyancy. This will occur when the average density of the object is equal to the density of the fluid it sits in—in the case of a pool cleaner this would be the pool water. Hence the preference is for the diverter 7 to have neutral buoyancy in the pool water so as to not impact, or at least minimise the impact, on the cleaner 4.

Figure 9:
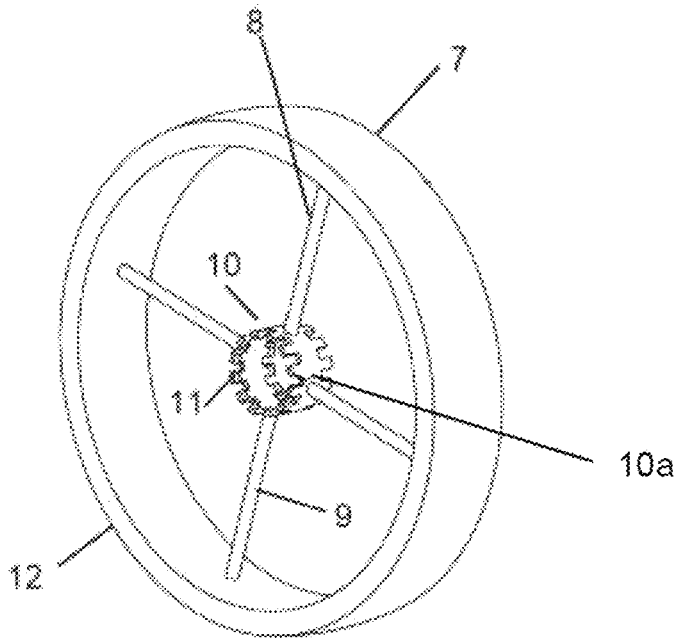
FIG. 9 illustrates an alternative embodiment of the present invention.

In one embodiment the diverter 7 could be moulded from a material being or incorporating a polymer, such as 20% talc filled polypropylene. This material has a specific gravity equal to water and is thus well suited for the purpose. As the material has a gravity equal to water, it is expected that diverters made from 20% talc filled copolymer polypropylene, would be substantially solid and moulded into the desired shape. For example, as shown in FIG. 9.

As further alternatives, the rim 12 of the diverter 4 could be blow moulded from HDPE (High Density Polyethylene) as a single part and filled with water, or the rim could be made from Polyvinyl Alcohol (PVA) sponge. A PVA sponge is highly absorbent and can hold up to 12 times its dry weight in the water. In this arrangement, the PVA sponge is designed to absorb the pool water whilst retaining its shape. By absorbing the pool water the diverter adopts a substantially neutral buoyancy.

Figure 10:
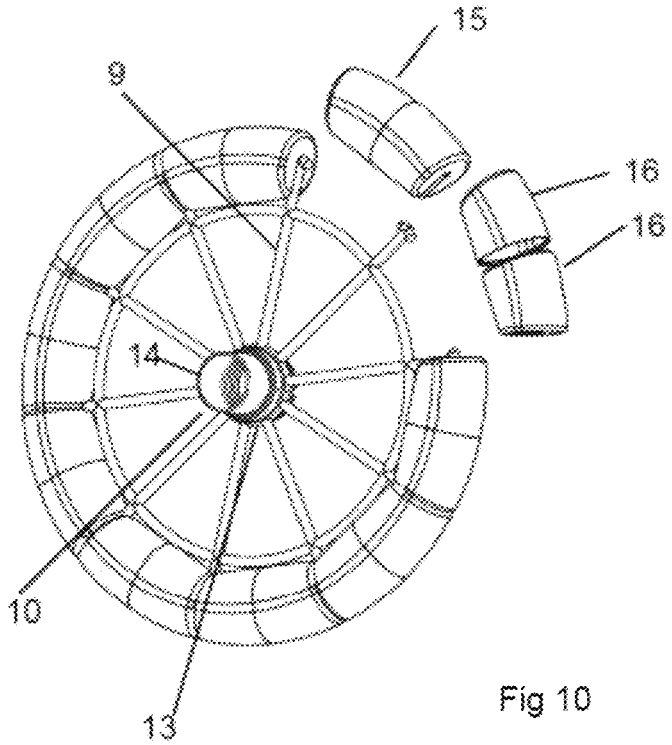
FIG. 10 illustrates another embodiment of the present invention.

A preferred arrangement is shown in FIG. 10. The rim 12 of the diverter 4 is formed by a plurality of compartments/containers 15, held in place by at least one rib 9, extending from a connector or hub, that attaches the diverter to the cleaner or pool hose.

The rib(s) 9 support and maintain the rim 12 in position, allowing the rim to extend beyond the footprint of the cleaner.

The compartments/containers may be filled with a substantially buoyancy neutral fluid or material in water, such as for example PVA foam.

Preferably, however, the containers would be hollow and able to be filled with pool water. The use of pool water will mean each container will have substantially neutral buoyancy. The weight of the container (and weight of the remainder of the diverter) will mean it will not be exactly neutral, however, using thin light weight plastic or similar, allows the device to approach neutral buoyancy. The goal would be neutral buoyancy; however, some positive or negative buoyancy can be compensated for without affecting the function of the cleaner.

A further advantage of filling the containers with pool water is shipping and storage of the diverter. That is, as the containers are empty, manufacturers and suppliers have lower freight costs due to the lower weight compared to a filled container.

Conveniently, each container 15 may be formed from two caps 16 able to snap fit together to form the container 15. The container 15 itself can also snap fit onto the ribs 9 of the diverter 4. The container 15 may include a recess at each end adapted to receive a male protrusion on the end of the rib 9. The male protrusion and recess operate together to hold the container in place.

In an alternative arrangement, the container could fit into a cage on the end of each rib, or each rib may include a claw like structure adapted to hold the container. In each case the container is retained in position.

In some implementations the container need not be sealed provided it is able to substantially retain its contents. For example, the container could be filled with PVA sponge.

Ideally, the cross section of the rim diameter should be around at least 15% of the outside rim diameter. For example, if the outside rim of a diverter is 300 mm, the cross section of the rim could be 45 mm Given the application, it is anticipated that most embodiments will be constructed from chlorine resistant materials such as, for example, Polypropylene (PP), Talc filled Propylene, High Density Polyethylene (HDPE), Acrylonitrile Styrene Acrylate (ASA), each of which are relatively easy to use in the manufacturing process.

The diverter 7 could be moulded as a single part, as shown for example in FIG. 9.

Alternatively, the diverter could be formed from a number of composite parts as shown in FIG. 10.

It is expected that in most embodiments a number of support members, such as ribs 9, will be included to provide some stability and support to the diverter 7.

The support members, such as the ribs 9, also act to join the wheel portion of the diverter 4 to a connector 10.

The number of actual support members (e.g. the ribs) is not important. What is necessary is that the ribs (or possibly rib) works to maintain the wheel portion joined to the connector.

For example, the support member(s) may include a web with one or more apertures therethrough, such as a sheet of rigid or semi-rigid material with holes therethrough to allow water to pass through.

The connector 10 is designed to connect or fix the diverter to the pool cleaner or pool hose.

In most cases, it is expected that the connector 10 will attach to, or form part of, the pool hose 5, simply for ease of installation and manufacture. In particular, this ensures redesign of the actual pool cleaner is not required. That is, the actual pool cleaner would not require additional connection points or significant modification. In some applications however, it may be preferred to attach the diverter to the actual pool cleaner 4.

Referring to FIG. 9, the connector 10 could have an adjuster means 10*a*, such as a number of flexible claws 11. The claws 11 could allow the diverter to slide along the pool hose 5, and then once in position lock the diverter in place.

An alternative arrangement of the connector 7 is shown in FIG. 10. The connector 10 may incorporate a hub 14, such as capable of being inserted between two adjacent pool hose lengths, or more likely, between the cleaner 4 and most adjacent or first pool hose. This arrangement would be preferred as the location of the diverter is known and is convenient for installation. However, it limits the ability for some adjustment to account for a specific application—in this case, the adjuster arrangement (such as the use of one or more claws) can be preferred.

In some embodiments, the diverter may come already attached to a length of pool hose. This would allow the end user to simply replace the pool hose length immediately connected to the pool cleaner with the diverter attached hose length.

In one arrangement, the connector 10 would include a circular section or tube 13 that is fixed to the support member(s) (e.g. ribs 9) and able to rotate around the hub 14. This effectively allows the diverter to spin around the hose with the hub acting as an axle. In this arrangement the diverter may be able to roll along the pool if it was to make contact, although it would be preferred that the diverter not make contact with the wall.

The connector hub 10 of FIG. 10 could be made from synthetic material, such as incorporating or being ethylene-vinyl acetate (EVA). Conveniently, most pool hoses are constructed from this same EVA material, thus the connector hub being made of EVA can better facilitate engagement with the cleaner. Alternatively, the hub could be made from high density polyethylene (HDPE)

Figure 7:
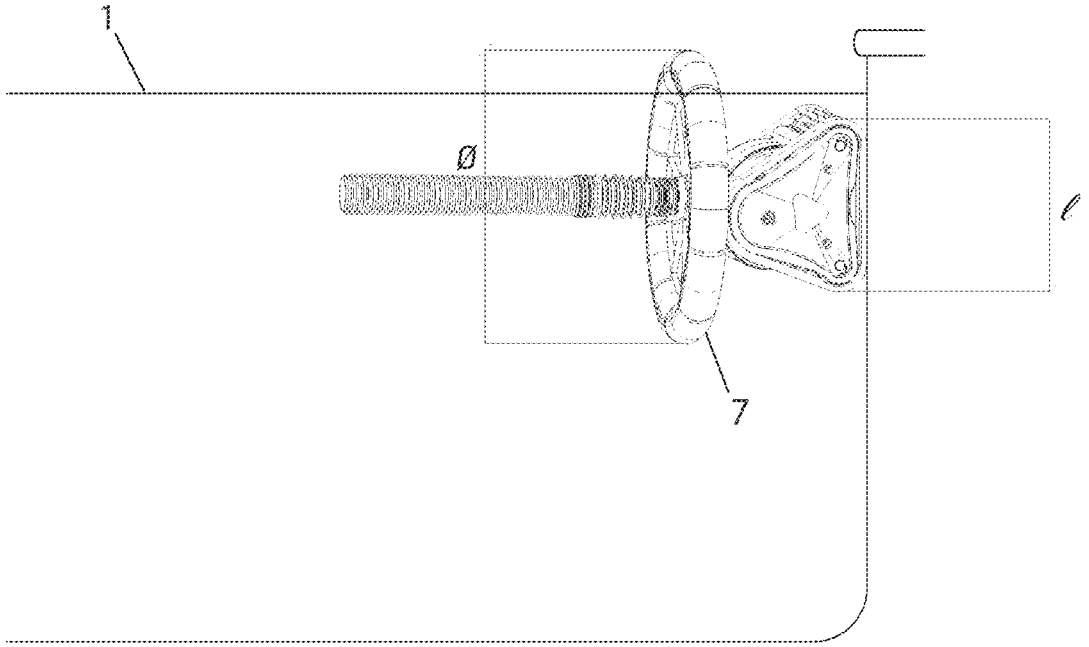
FIG. 7 illustrates a diverter of one embodiment of the present invention attached proximate a pool cleaner.

Preferably, the outside diameter (ø) size of the diverter should be larger than the length (l) of the cleaner as shown in FIG. 7. For example, if the diverter is smaller than the cleaner is, then it is likely that the cleaner will be able to climb a pool wall and suck air before the undersized diverter breaches the surface of the pool water.

Ideally, the relative size of the diverter would be at least 130% the size of the cleaner. That is, if the length of the cleaner was 300 mm the diverter would be 390 mm. When the diverter is proximate the cleaner as shown in FIG. 7, the preferred size ratio of the diverter is approximately 165% that of the length of the cleaner. For example, if the size of the cleaner was 200 mm the diverter would ideally have an outside diameter of 330 mm. Alternatively, if the size of the cleaner was 300 mm the diverter would ideally be 495 mm.

Figure 8:
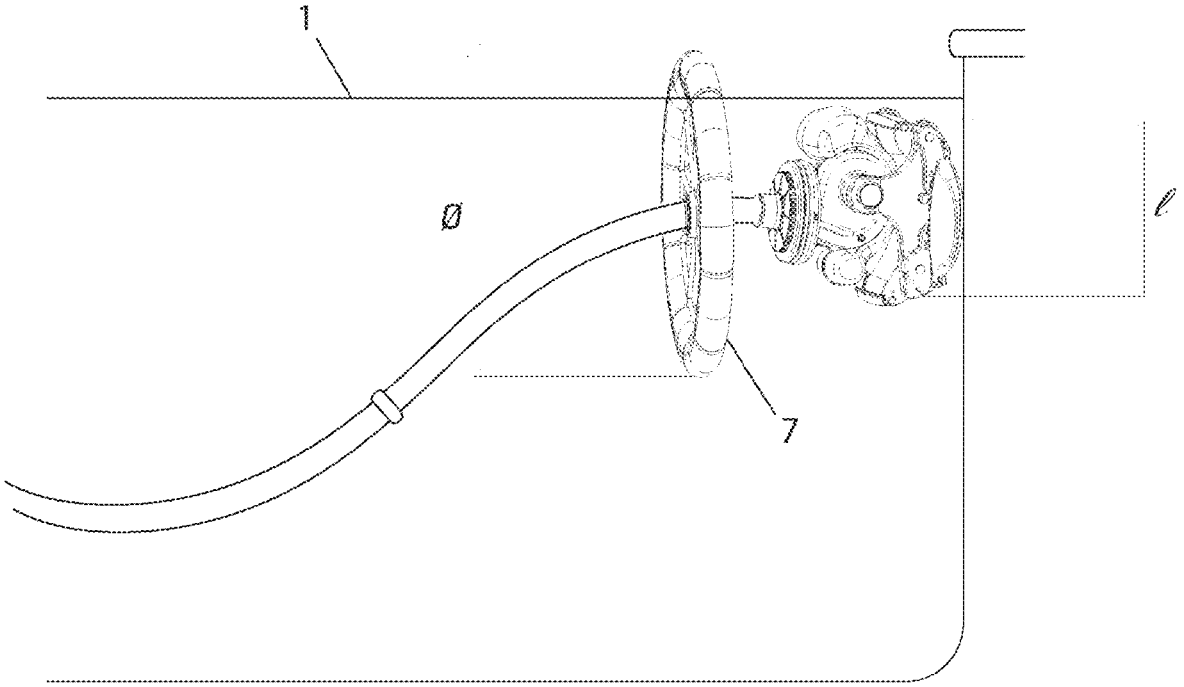
FIG. 8 illustrates a diverter of one embodiment of the present invention spaced away from a pool cleaner.

If the diverter is located further along the pool tube away from the cleaner, as shown in FIG. 8, the size of the diverter could be up to 200% of the length (l) of the cleaner. For example, if the size of the cleaner was 200 mm, the diverter size could be 400 mm.

The diverter position on the pool tube preferably would be equal to the size of the diverter (l) distance from the pool floor when the cleaner is on the floor. If the diverter was positioned further from the cleaner, due to the flexibility of the pool hose the leverage action (piling) could be compromised.

Ideally, the minimum distance from the diverter to the pool floor is around the length of the cleaner. For example, if the cleaner is 200 mm wide the diverter minimum height distance should be 200 mm from the pool floor. This is to ensure the diverter is able to break the surface of the water prior to the cleaner, or at least prior to the cleaner being able to suck in air but is not too close that it could cause an obstruction or prevent the cleaner from climbing up towards the water surface. The preferred maximum height of the diverter from the pool floor would be the outside diameter of the diverter. This is to ensure the diverter is able to break the surface of the water and create sufficient leverage to overcome the suction force of the cleaner and peel the cleaner of the pool wall, before the cleaner begins sucking in air.

Figure 11:
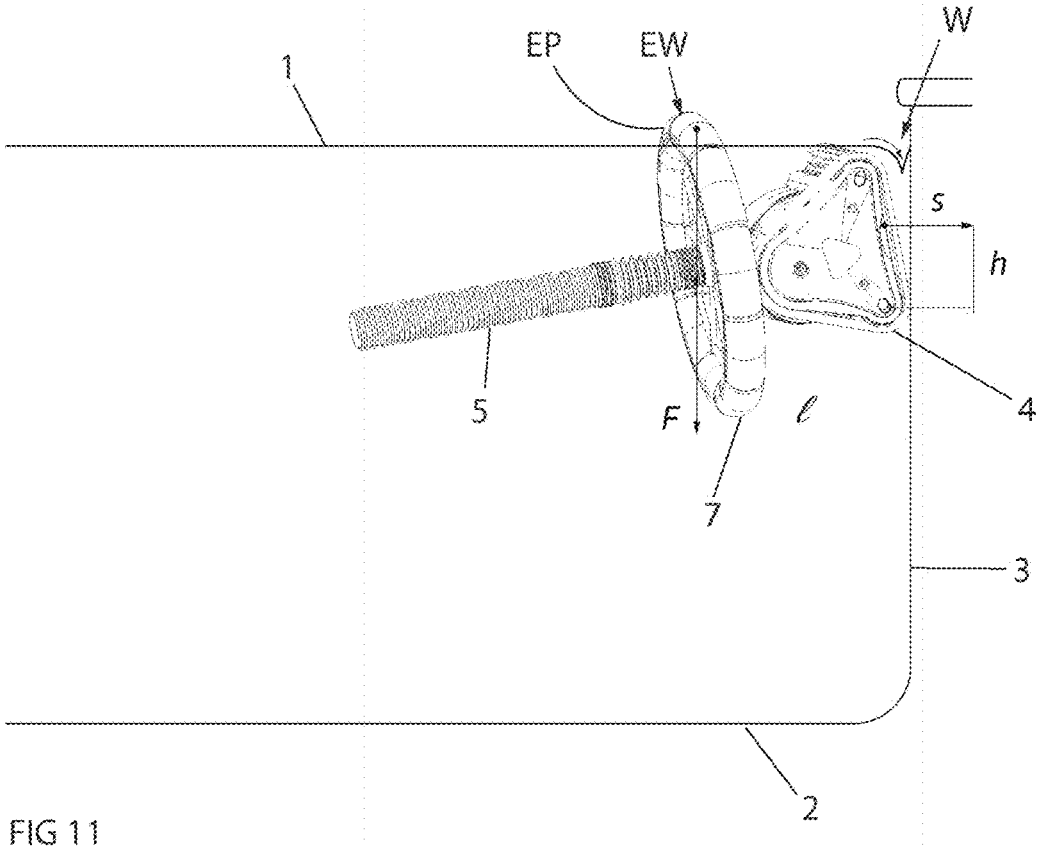
FIG. 11 illustrates the working of the present invention.

The diverter 7 acts to prevent the cleaner 4 climbing too far up the pool wall, and in particular from breaching the pool surface and sucking in air. The unique action of the diverter 7 can be seen in FIG. 11 or in FIG. 12.

As the cleaner 4 approaches the pool water surface 1, the diverter 7 breaks/breaches/emerges (EW) through the water surface 1.

The weight of the exposed part (EP) of the diverter 7 above the water surface 1 is acting in a downward force.

The downward force (F) which is acting at the distance (1), peels or lifts the top most part of the cleaner 4 from the surface of the pool wall 3. As the cleaner 4 peels away from the wall 3, the suction force (S) of the cleaner 4 keeping the cleaner on the wall 3 is reduced, as is the upward traction of the cleaner against the wall 3. The pool cleaner is able to suck-in water (W) as the cleaner peels away.

As the cleaner 4 continues to climb up the wall 3, more of diverter 7 extends above the water surface 1, further increasing the downward force F, and reducing the suction force S, to the point that the cleaner 4 will stop climbing and as a result may change direction or slide downwards. The cleaner 4 may also detach from the wall 3 at which point it would then float back down to the pool floor 2.

The leverage action of the diverter can be explained by the following formula: $F \times l = S \times h$ therefore $S = F \times l/h$, where h is the distance between the bottom of the cleaner and the point where the suction force acts against the wall.

By changing the rim section, that is the outside diameter (Ø) of the diverter and distance "l" the action of the diverter can be adjusted to any pool cleaner In the preferred arrangement as shown in FIGS. 6 to 11, the diverter is a complete circle (or substantially circular). However, in some embodiments a full circle may not be employed.

Referring to FIG. 10, the diverter may, for example, omit every second or third container. If the diverter was fixed (and not rotational) it would still be highly likely that the diverter would breach the water surface before the cleaner.

In a further arrangement, a diverter may only have containers (or the like) on ribs extending north, south, east and west, from the hub. In this arrangement it is expected that the containers would be slightly larger than those depicted in FIG. 10. This would be to reduce the risk of the cleaner breaching the surface first if the cleaner was to approach on a particular angle.

Figure 12:
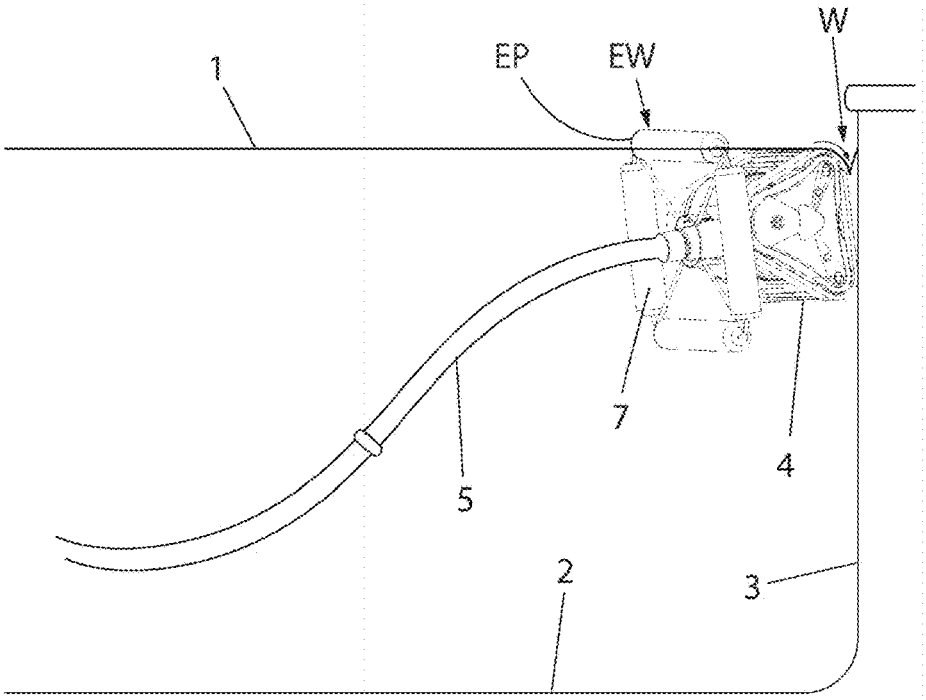
FIG. 12 shows an alternative arrangement of the present invention.

Alternatively, the compartments/containers could form a square shape as shown in FIG. 12.

In this arrangement, the compartments/containers can include or be made from foam, such as PVA foam.

The compartments/containers can be tubes or rollers. They may rotate on a ridged structure, such as a frame having a rim 7, attached to the main body of the cleaner.

The tubes or rollers can be or include foam, such as PVA foam.

Roller action of the PVA foam tube/rollers, by engaging with the flow of the pool and rotating could help the cleaner climb upwards, and at the same time may also provide some cleaning of the pool.

While the present invention is particularly applicable to mechanical suction type cleaners, it could also be used on electrical type cleaners. The diverter of the present invention would allow an electrical cleaner to omit electronic sensors designed to detect the water surface, thereby reducing the cost and complexity of the cleaner.

Alternatively, it could be installed as a failsafe to guard against sensor malfunction.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment.

Moreover, in interpreting the disclosure, all terms should be interpreted in the broadest reasonable manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Furthermore, the particular features, structures, or characteristics may be combined in any suitable manner in one or more combinations. It will be appreciated that persons skilled in the art could implement the present invention in different ways to the one described above, and variations may be produced without departing from its spirit and scope.

Any discussion of documents, devices, acts or knowledge in this specification is included to explain the context of the invention. It should not be taken as an admission that any of the material forms part of the prior art base or the common general knowledge in the relevant art, in any country, on or before the filing date of the patent application to which the present specification pertains.

What is claimed is:

1. A swimming pool cleaner water surface diverter, wherein the diverter connects to or is part of a swimming pool cleaner having a hose attached to the pool swimming cleaner at approximately 90° to a surface of a swimming pool on which the pool cleaner travels, wherein the diverter includes at least one support member extending from a central hub to a rim, said rim extending beyond a footprint of the pool cleaner, and wherein a portion of the diverter is arranged and configured, in use, to breach a surface of the water and restrict or prevent the pool cleaner from breaching the water surface sufficient for the pool cleaner to intake air.

2. The diverter of claim 1, wherein the central hub provides an axle housing.

3. The diverter as claimed in claim 1, wherein the rim is annular, oval or substantially circular.

4. The diverter as claimed in claim 1, wherein said rim substantially has neutral buoyancy.

5. The diverter as claimed in claim 1, wherein said rim includes a plurality of compartments or containers, wherein the compartments/containers are filled with a substantially buoyancy neutral fluid or material in water.

6. The diverter of claim 5, wherein the material is or includes PVA foam.

7. The diverter of claim 5, wherein one or more of the compartments/containers is at least partially hollow and configured to receive pool water.

8. The diverter of claim 7, wherein the diverter has substantially neutral buoyancy or approaching neutral buoyancy in the swimming pool when the one or more compartments/containers contain the pool water.

9. The diverter of claim 7, wherein some positive or negative buoyancy is compensated for without affecting the function of the pool cleaner.

10. The diverter of claim 5, wherein each compartment/container comprises multiple caps that connect together.

11. The diverter of claim 5, wherein one or more said compartments/containers connects onto a rib of the diverter, or fits into a cage on an end of said rib, or the rib includes a claw like structure adapted to hold the respective compartment/container.

12. The diverter of claim 5, wherein the respective compartment/the container is at least partially filled with PVA sponge or other sponge or open cell material.

13. The diverter of claim 1, wherein a cross section through a thickness of a peripheral diameter of the rim is around at least 15% of an overall diameter of the rim diameter.

14. The diverter of claim 1, wherein the diverter is configured to attach to, or form part of, a pool hose or to the pool cleaner.

15. The diverter of claim 1, wherein the diverter includes a connector to attach the diverter to a pool hose, the connector including an adjuster means to allow positioning of the diverter on the pool hose.

16. The diverter of claim 15, wherein the adjuster means includes a number of flexible claws, teeth or tines to allow positioning and locking the diverter in place on the pool hose.

17. The diverter of claim 14, including an annular, tube, circular or ring like device connectable to the pool hose, and a hub to which the support member(s) is/are connected, the hub being able to rotate around the pool hose.

18. The diverter of claim 1, wherein an outside diameter (ø) of the diverter is larger than a length (1) of the pool cleaner.

19. The diverter of claim 18, wherein:

relative width of the diverter is at least 130% the width of the pool cleaner, or when the diverter is proximate the pool cleaner in use, the size ratio of the diverter is approximately 165% that of the length of the pool cleaner; or when the diverter is located along the pool hose away from the pool cleaner, the size of the diverter is up to 200% of the length (1) of the pool cleaner.

20. The diverter of claim 1, wherein:

a position of the diverter on the pool hose is about equal to the size of the diverter (I) distance from a floor of the swimming pool when the pool cleaner is on the floor; or a minimum distance from the diverter to the pool floor is around the length of the pool cleaner; or a maximum height of the diverter from the pool floor is approximately the outside diameter of the diverter.

* * * * *